US007134187B2

(12) United States Patent
Liu et al.

(10) Patent No.: US 7,134,187 B2
(45) Date of Patent: Nov. 14, 2006

(54) METHOD FOR MAKING AN INKJET-HEAD CHIP STRUCTURE

(75) Inventors: Chien-Hung Liu, Hsinchu (TW); Jian-Chiun Liou, Hsinchu (TW); Chi-Ming Huang, Hsinchu (TW); Chia-Cheng Chiao, Hsinchu (TW); Chun-Jung Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 244 days.

(21) Appl. No.: 10/860,240

(22) Filed: Jun. 3, 2004

(65) Prior Publication Data

US 2005/0104935 A1 May 19, 2005

(30) Foreign Application Priority Data

Nov. 14, 2003 (TW) ..... 92132074

(51) Int. Cl.
*H05B 3/00* (2006.01)

(52) U.S. Cl. ..... 29/611; 29/620; 29/825; 29/846; 29/890.1; 216/27; 257/327; 257/368; 347/57; 347/59; 347/63; 438/21; 438/59

(58) Field of Classification Search ..... 29/611, 29/620, 825, 846, 890.1; 216/27; 257/327, 257/368; 347/57, 59, 63; 438/21, 59
See application file for complete search history.

(56) References Cited

U.S. PATENT DOCUMENTS 6,814,428 B1 * 11/2004 Huang et al. ..... 347/50
6,841,830 B1 * 1/2005 Liu et al. ..... 257/368

* cited by examiner

*Primary Examiner*—A. Dexter Tugbang
*Assistant Examiner*—Tim Phan
(74) *Attorney, Agent, or Firm*—Welsh & Katz, Ltd.

(57) ABSTRACT

A structure of inkjet-head chip and a method for making the same are disclosed. Driven by the need of making a thin insulator layer to lower the working power of the inkjet-head chip, we separately manufacture a passivation layer and a second conductive layer. The passivation layer and the second conductive layer have to be formed from different materials. The defining means for the passivation layer and the second conductive layer have high selectivity and do not overetch or damage the structure of inkjet-head chip.

8 Claims, 2 Drawing Sheets

METHOD FOR MAKING AN INKJET-HEAD CHIP STRUCTURE

BACKGROUND OF THE INVENTION

1. Field of Invention

The invention relates to a structure of inkjet-head chip and its manufacturing method. In particular, the invention relates to a structure of inkjet-head chip and its manufacturing method for low inkjet power uses.

2. Related Art

With several breakthroughs in the printing technology of inkjet printers, there are higher demands in better quality and resolution of printing. To achieve higher printing resolutions, the size of ink droplets has to be smaller. Under the same conditions, however, the higher the resolution is the lower the printing speed will be. In order to simultaneously increase the printing speed and resolution, a practical solution is to increase the number of nozzles on a single inkjet-head chip.

To achieve the goal, it is common to integrate driving elements with switches and active characters, such as transistors, with inkjet actuators onto a single inkjet-head chip. The number of packaging contact points X and the number of nozzles Y on the inkjet-head chip is increased from one-to-one (X=Y) to one-to-many ($Y=(X/2)^2$). Such integrated drive head chips (such as those using thermal bubble to drive ink droplets) are usually made by serially connecting metal oxide semiconductor field effect transistor (MOSFET) with an inkjet actuator. The inkjet actuator is the resistor for heating the ink. Such a resistor is called the thermal resistor. The external contact points and the thermal resistor thus render a one-to-many mode. The thermal resistor heats up the ink to produce bubbles, which push ink droplets out. In order for the driving element to provide sufficient power, the resistance of other circuits has to be reduced so that the resistance of the thermal resistor is close to that of the whole loop. Most of the power concentrates on the thermal resistor to be converted to heat. Therefore, it can produce a better bubble generating efficiency.

To focus the power on the thermal resistor, a common method is to utilize field effect transistors (FET) with a larger channel width/length ratio (aspect ratio) to reduce the serial parasitic resistance. Nevertheless, the area occupied by the FET with a large aspect ratio is often much greater than other elements in the chip. In order to increase the resolution, one wants to minimize the FET area. This inevitably adds the system parasitic resistance other than the thermal resistor. A preferred solution is to increase the resistance of the thermal resistor, especially for the inkjet-head with smaller ink droplets because the power needed to eject a singlet droplet is smaller. The power is proportional to the product of the square of voltage and the thermal resistance ($R_{heater}$), but inversely proportional to the square of the sum of the thermal resistance and the parasitic resistance $(R_{heater}+R_{parasitic})^2$. Therefore, $P=V_{PP}^2\times R_{heater}/(R_{heater}+R_{parasitic})^2$. If the voltage provided by the printer is not increased, increasing the thermal resistance will lower the power generated by the thermal resistor.

One solution for this problem is to reduce the thickness of the interlayer insulator above the thermal resistance, lowering the heat loss from the thermal resistor to the ink. The interlayer insulator is usually made of $Si_3N_4$ and SiC. However, one needs to make a second conductive layer and a passivation layer after the interlayer insulator. The interlayer insulator has to be completely insulating in order to separate the circuits in the inkjet-head chip. The insulating property of the interlayer insulator thus affects the yield of the inkjet-head chip. The interlayer insulator above the thermal resistor is where the thermal bubble inkjet-head and the ink have a contact. Therefore, it needs a passivation layer to separate the ink. To overcome the bubble-collapsed force and the chemical properties of the ink over a long time, the passivation layer has to use materials with high melting points, being chemically stable and robust (such as Ta). These passivation layers have to employ high-energy dry etching, active ion etching or wet etching with strong acids or oxidants. Such kinds of etching can easily break the insulation of the passivation layer. If one reduces the thickness of the passivation layer, the damages will be more serious.

SUMMARY OF THE INVENTION

The invention provides a structure of inkjet-head chip and the method for making the same. The lift-off method is used to define the passivation layer. This avoids hurting the interlayer insulator underneath. The passivation layer and a second conductive layer above the interlayer insulator are manufactured separately. The two layers are made of different materials. The second conductive layer above the interlayer insulator can be manufactured using wet etching. The etchant solution used in the wet etching has a high selectivity and does not hurt other parts or cause overetches. The insulating property will not be affected even if the thickness of the interlayer insulator is reduced.

The method of making the disclosed inkjet-head chip is to first form a transistor on a substrate. A thermal resisting layer is formed on the transistor. The thermal resisting layer with an electrical current imposed by the transistor produces heat to heat up the ink, generating bubbles to push the ink out. Afterwards, a first conductive layer is formed with a sheet resistance lower than the sheet resistance of the thermal resisting layer. The first conductive layer is attached to the thermal resisting layer to have an electrical contact. An interlayer insulator is deposited with a thickness smaller than the thickness sum of the first conductive layer and the thermal resisting layer. A sacrifice layer is defined on the surface of the interlayer insulator so that only the area that is to be covered by a passivation layer is exposed. A passivation layer is then deposited, followed by removing the photoresist layer. A second conductive layer is formed on the interlayer insulator. The second conductive layer is defined by wet etching. Its material is different from the material of the passivation layer.

According to the above-mentioned manufacturing method, the inkjet-head chip structure is established on the surface of a substrate containing a transistor. The structure further contains a thermal resisting layer, a first conductive layer, an interlayer insulator, a passivation layer, and a second conductive layer. The thermal resisting layer generates heat as a result of an electrical current controlled by the transistor flows through the thermal resisting. The heat heats up the ink to produce bubbles that push ink droplets out. The first conductive layer has a sheet resistance smaller than the resistance of the thermal resisting layer. The first conductive layer and the thermal resisting layer are attached together and have an electrical contact. The interlayer insulator has a thickness smaller than the sum of the first conductive layer and the thermal resisting layer. The passivation layer is formed above the interlayer insulator. The second conductive layer is formed above the interlayer insulator, and its material is different from that of the passivation layer. The two of them do not have any electrical connection.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

Figure 1:
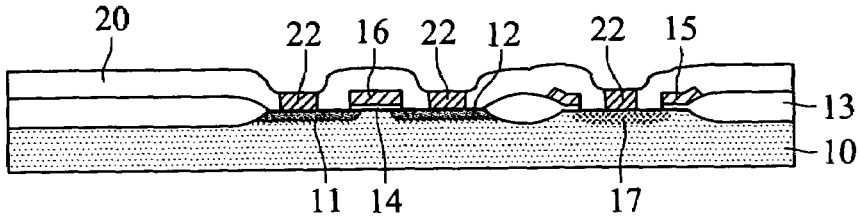
FIG. 1 shows a schematic structure of the n-channel MOSFET.

We take an n-channel metal oxide semiconductor field effect transistor (MOSFET) built on a Si-substrate as an example and use it in the disclosed inkjet-head chip structure. With reference to FIG. 1, a stress buffering oxide layer first formed on the surface of the Si-substrate 10. The stress buffering oxide layer is then formed to be a thick oxide layer 13, i.e. Local oxidation on silicon (LOCOS), by high-temperature wet oxidation. This defines the active region of an n-channel MOSFET without a thick oxide layer and the active region for base contact 17. The active region is grown with a gate insulator 14. Polysilicon is deposited on the gate insulator to form the gate 16 of the MOSFET and the base barrier layer against dopants 15. BPSG 20, formed by reflow, covers the Si-substrate 10. The places corresponding to the drain 11 and the source 12 on the BPSG 20 are formed with contact holes, each of which is filled with an insulating material 21 with a high melting point. This can avoid spiking at the Al—Si contact at the drain 11 and the source 12 in subsequent processes.

The disclosed inkjet-head chip structure is formed by combining the above-mentioned n-channel MOSFET with an actuator established thereon. The n-channel MOSFET is electrically connected to the actuator. The gate voltage controls the current flowing through the actuator. The actuator is connected to the fluid channel structure to provide energy for ink to be ejected out of the nozzles.

Please refer to FIGS. 2 to 7 for the manufacturing process in an embodiment of the invention.

Figure 2:
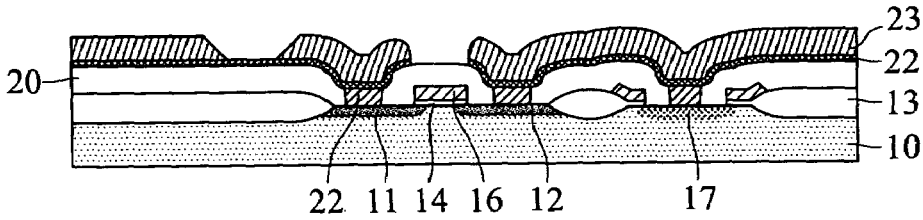
FIGS. 2 to 7 are plots showing the manufacturing procedure according to an embodiment of the invention.

As shown in FIG. 2, a thermal resisting layer 22 and a first conductive layer 23 are deposited on the surface of the BPSG 20 above the Si-substrate 10 that contains the n-channel MOSFET. First, the thermal resisting layer 22 is formed on the transistor. The thermal resisting layer 22 produces heat when a current is imposed by the transistor. The heat generates bubbles to push ink droplets out. The first conductive layer 23 is formed on the surface of the thermal resisting layer 22. Its sheet resistance is smaller than the sheet resistance of the thermal resisting layer 22. The thickness of the first conductive layer 23 is 2500 Å~7000 Å.

Figure 3:
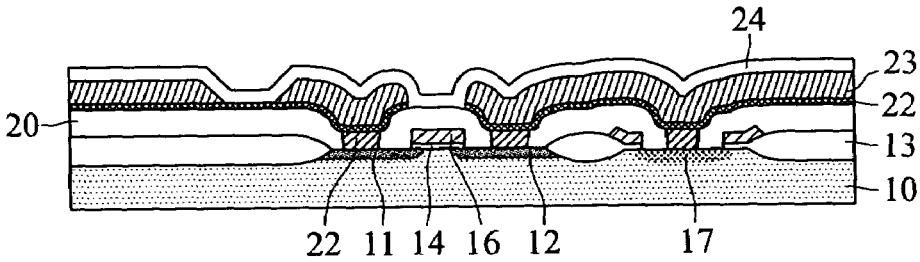

As shown in FIG. 3, an interlayer insulator 24 composed of $S_3N_4$/SiC on the substrate surface of the first conductive layer and the thermal resisting layer. The thicker the interlayer insulator 24 is, the more energy it will cost to generate bubbles. In order to produce bubbles at a lower power, the thickness of the interlayer insulator 24 has to be smaller than the thickness sum of the thermal resisting layer 22 and the first conductive layer 23.

Figure 4:
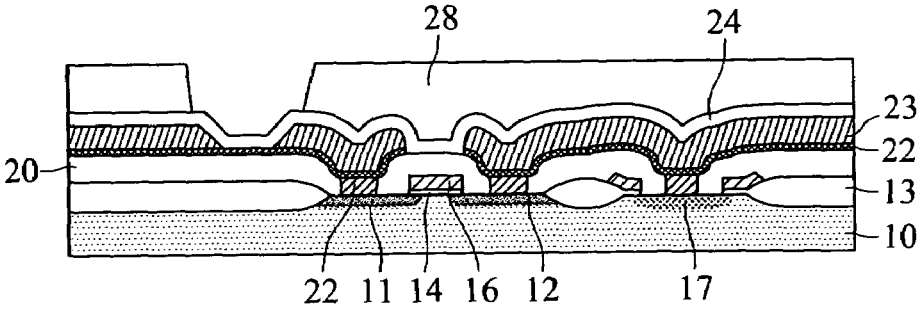

The lift-off method is applied to define the passivation layer, so a photoresist layer is used for a sacrifice layer. As shown in FIG. 4, the photoresist layer 28 is defined on the surface of the interlayer insulator 24. Only the area of the interlayer insulator 24 reserved for the passivation layer is exposed.

Figure 5:
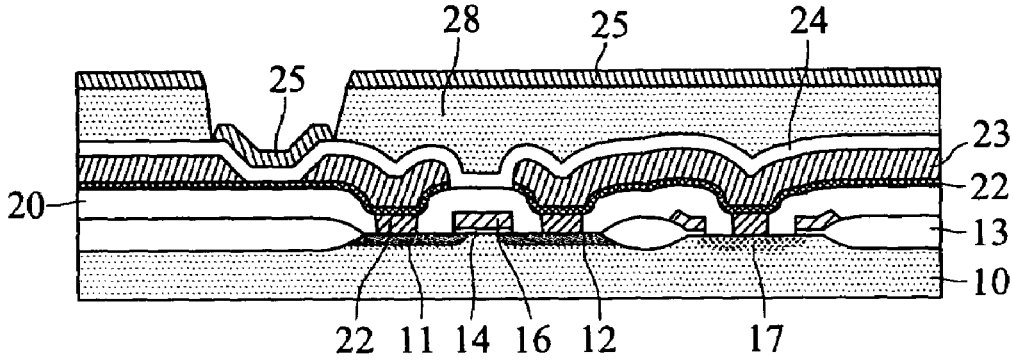

As shown in FIG. 5, the photoresist layer 28 is deposited with the passivation layer 25. The area of the interlayer insulator 24 reserved for the passivation layer is directly covered by the passivation layer 25.

Figure 6:
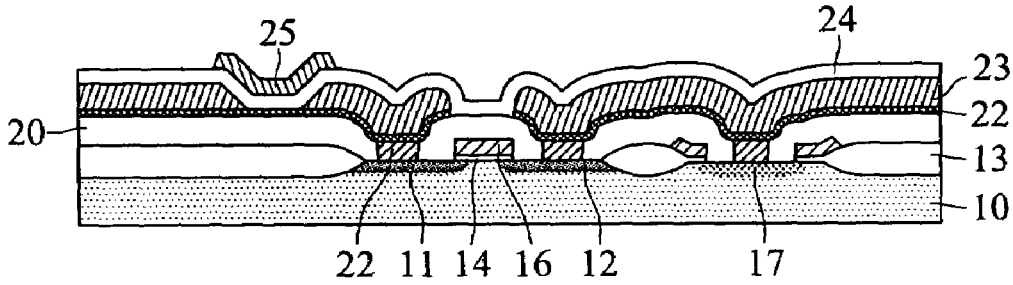

As shown in FIG. 6, the photoresist layer 28 is removed, defining the passivation layer 25.

Figure 7:
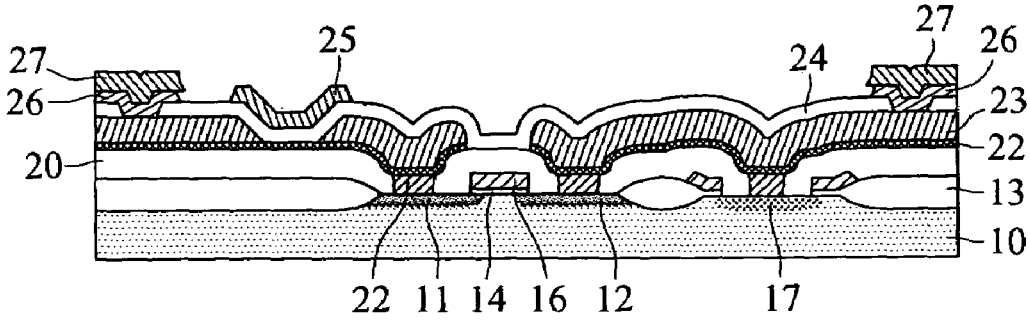

As shown in FIG. 7, a second conductive layer 27 is formed above the interlayer insulator 24. The material of the second conductive layer 27 can be gold. Its etchant solution can be KI. The second conductive layer 27 and the passivation layer 25 have no electrical connections. In addition to being the second wire in the inkjet-head chip, the second conductive layer 27 also functions as the connecting point with an external soft circuit board. Therefore, one can insert a metal interlayer insulator 26 with a high melting point under the second conductive layer 27 to enhance the binding force between the connecting point and the soft circuit board. The metal interlayer insulator 26 can use a Ti—W alloy. The etchant is the $H_2O_2$ solution. The metal interlayer insulator 26 has to be made of a metal, semiconductor, alloy or compound that has a melting point higher than 650 degrees of Celsius and a resistivity below $5.0\times10^{-3}$ Ω-cm. It should be noted that the metal interlayer insulator 26 has to be a different material from that of the passivation layer 25 to avoid etching damages.

The material of the passivation layer 25 is selected from Ta, W, Cr, Ni, Ti, Si, and their alloys. The material of the second conductive layer 27 is selected from Au, Al, Cu, Ag, and their alloys.

Using the disclosed method, the power for producing bubbles in the inkjet-head chip with a thin interlayer insulator can be achieved using a simple manufacturing process. There is no need to use an etchor or end-point detector. Since each layer after the interlayer insulator does not employ high-energy dry etching, active ion etching or wet etching with strong acids or oxidants, the etching damages to the interlayer insulator can be effectively avoided.

Certain variations would be apparent to those skilled in the art, which variations are considered within the spirit and scope of the claimed invention.

What is claimed is:

1. A method of making an inkjet-head chip structure from a substrate formed with at least a transistor and an actuator, the method comprising the steps of:

forming a thermal resisting layer on the substrate, the thermal resisting layer generating actuating energy from an electrical current/voltage provided by the transistor to push out ink droplets;

forming a first conductive layer whose sheet resistance is smaller than the thermal resisting layer, the first conductive layer and the thermal resisting layer being attached to each other and in an electrical contact;

forming an interlayer insulator covering the substrate surface, the thickness of the interlayer insulator being smaller than the sum of the first conductive layer and the thermal resisting layer;

defining a sacrifice layer on the surface of the interlayer insulator, exposing only the area of the interlayer insulator for forming a passivation layer;

depositing the passivation layer and removing the photoresist or sacrifice layer; and forming a second conductive layer on the interlayer insulator, the material of the second conductive layer being different from that of the passivation layer.

2. The method of claim 1, wherein the thickness of the first conductive layer is between 2500 Å and 7000 Å.

3. The method of claim 1, wherein the material of the passivation layer is selected from the group consisting of Ta, W, Cr, Ni, Ti, Si, and their alloys.

4. The method of claim 1, wherein the interlayer insulator is made of $S_3N_4$ and SiC.

5. The method of claim 1, wherein the material of the second conductive layer is selected from the group consisting of Au, Al, Cu, Pt, Ag, and their alloys.

6. The method of claim 1, wherein the second conductive layer further contains a metal interlayer insulator.

7. The method of claim 6, wherein the material of the metal interlayer insulator is a non-insulating material with a melting point higher than 650 degrees of Celsius and a resistivity below $5.0\times10^{-}\Omega$-cm.

8. The method of claim 1, wherein the sacrifice layer is a photoresist layer.

* * * * *